US009711120B1

(12) United States Patent
Pogoda

(10) Patent No.: US 9,711,120 B1
(45) Date of Patent: Jul. 18, 2017

(54) PIANO-TYPE KEY ACTUATOR WITH SUPPLEMENTAL ACTUATION

(71) Applicant: Gary S. Pogoda, Atlantic City, NJ (US)

(72) Inventor: Gary S. Pogoda, Atlantic City, NJ (US)

( * ) Notice: Subject to any disclaimer, the term of this patent is extended or adjusted under 35 U.S.C. 154(b) by 0 days.

(21) Appl. No.: 15/177,774

(22) Filed: Jun. 9, 2016

(51) Int. Cl.
*G10H 1/18* (2006.01)
*G10H 1/34* (2006.01)

(52) U.S. Cl.
CPC ..... *G10H 1/344* (2013.01); *G10H 1/18* (2013.01); *G10H 1/34* (2013.01); *G10H 2220/275* (2013.01)

(58) Field of Classification Search
CPC ..... G10H 1/18; G10H 1/34
USPC ..... 84/615, 653, 644
See application file for complete search history.

(56) References Cited

U.S. PATENT DOCUMENTS 4,099,438 A * 7/1978 Hiyoshi ..... G10H 1/055 84/629
4,498,365 A * 2/1985 Tripp ..... G10H 1/055 84/433
4,665,788 A * 5/1987 Tripp ..... G10H 1/055 341/33
7,723,597 B1 * 5/2010 Tripp ..... G10H 1/344 84/423 R

* cited by examiner

*Primary Examiner* — David Warren
(74) *Attorney, Agent, or Firm* — Norman E. Lehrer

(57) ABSTRACT

The present invention provides a piano-type key actuator that employs supplemental actuation so as to enable an associated key to become engaged when a typical actuation force is applied anywhere along its entire length, including from within the immediate vicinity of its pivot point, where the key would otherwise be unusable for playing due to the prohibitively large actuation force that would generally be required in this area. By eliminating the unusable portion of a key, a full-function keyboard can be provided in a more compact and portable form.

9 Claims, 9 Drawing Sheets

PIANO-TYPE KEY ACTUATOR WITH SUPPLEMENTAL ACTUATION

BACKGROUND OF THE INVENTION

The present invention is directed toward a piano-type key actuator, and more specifically, toward one that employs supplemental actuation, so as to enable an associated key to become engaged by applying a typical actuation force at any point along its length, including points within the immediate vicinity of its pivot point, thereby enabling the entire length of that key to be utilized for playing.

As musical instruments go, 88-key piano keyboards are somewhat difficult to lug around due to their size. In an attempt to improve their portability, manufacturers have offered keyboards with a reduced number of keys, as well as a reduced key size; however, such improvements tend to limit the functionality of the keyboard, which may, in turn, prevent it from being used for serious playing.

This invention addresses that keyboard portability issue by providing an actuator that enables a piano key to become engaged when a typical actuation force is applied anywhere along its entire length. Due to the prohibitively large actuation force that would generally be required to actuate a piano key near its pivot point, that end of the key is typically blocked by the casing of the keyboard. Since the present invention would enable a piano key to be actuated from any point along its length, the previously blocked key portion can be eliminated, and a more compact and portable keyboard can be provided, while still maintaining full keyboard functionality.

It should be understood that, although the present invention is described below with respect to actuators for piano-type keys, which includes keys for electronic and acoustic pianos, as well as for organs, accordions, and other keyboard instruments, this invention is in no way limited to such actuators, and could just as easily have been described with respect to actuators for any type of lever beam or actuated mechanism by one skilled in the art.

As such, a piano keyboard will be recognized by one skilled in the art as a lever actuator apparatus, where each piano key can be viewed as a lever, consisting of a lever beam connected to a fulcrum around which the lever beam can be displaced by an actuation force applied perpendicularly to its top surface, where the lever arm portion of the lever beam extends, from the location of the fulcrum along the lever beam, to the location of the applied actuation force along the lever beam, and where displacement of the lever arm pivotally actuates a linked mechanism to sound an associated note.

When a nominal actuation force is applied to the lever beam in very close proximity to the fulcrum, the resulting lever arm length will undoubtedly be insufficient to pivotally actuate the linked mechanism. To remedy this situation, the present invention provides a first supplemental actuation means that will instead linearly displace the lever arm in the direction of the applied force, so as to trigger the linked mechanism.

Similarly, if a nominal actuation force is applied in not-so-close proximity to the fulcrum, the resulting lever arm length may still be insufficient to pivotally actuate the linked mechanism. To remedy this situation, the present invention lines the lever beam with touch sensors along its top surface to quantify the resulting lever arm length, and it provides a second supplemental actuation means, that will augment the actuation force with an auxiliary force that is inversely proportional to the lever arm length, and that will pivotally displace the lever arm with the augmented actuation force, so as to trigger the linked mechanism.

It should also be understood that, while the present invention is described below with respect to a single, piano, white key, this is for illustrative purposes only, and should in no way be construed as a limitation on the application of the invention. In fact, piano keyboards have historically been associated with many types of key combinations and arrangements, from the standard interleaved pattern of 5 black and 7 white keys, to countless other non-standard patterns, and as would be obvious to one skilled in the art, the present invention is applicable to all such combinations and arrangements of keys.

It should further be understood that, although this invention is described below with respect to a simple key, hinge, and momentary, pushbutton switch, this is, again, for illustrative purposes, and again, should, in no way be construed as a limitation on the application of the invention. In fact, piano keyboards have long been associated with numerous expression enhancements, including countless types of sustain pedals, weighted-action keys, touch-sensitive keys, velocity-sensitive keys, pressure-sensitive keys, displacement-sensitive keys, etc., and as would be obvious to one skilled in the art, the present invention is applicable to all such expression enhancements.

As should be evident from the above discussion, the present invention is very broad in scope.

SUMMARY OF THE INVENTION

The present invention provides a piano-type key actuator that employs supplemental actuation so as to enable an associated key to become engaged when a typical actuation force is applied anywhere along its entire length, including from within the immediate vicinity of its pivot point, where the key would otherwise be unusable for playing due to the prohibitively large actuation force that would generally be required in this area. By eliminating the unusable portion of a key, a full-function keyboard can be provided in a more compact and portable form.

BRIEF DESCRIPTION OF THE DRAWINGS

For the purpose of illustrating the present invention, there are shown in the accompanying drawings, forms that are presently preferred; it being understood that the invention is not intended to be limited to the precise arrangements and instrumentalities shown.

DETAILED DESCRIPTION OF THE PREFERRED EMBODIMENT

Figure 1:
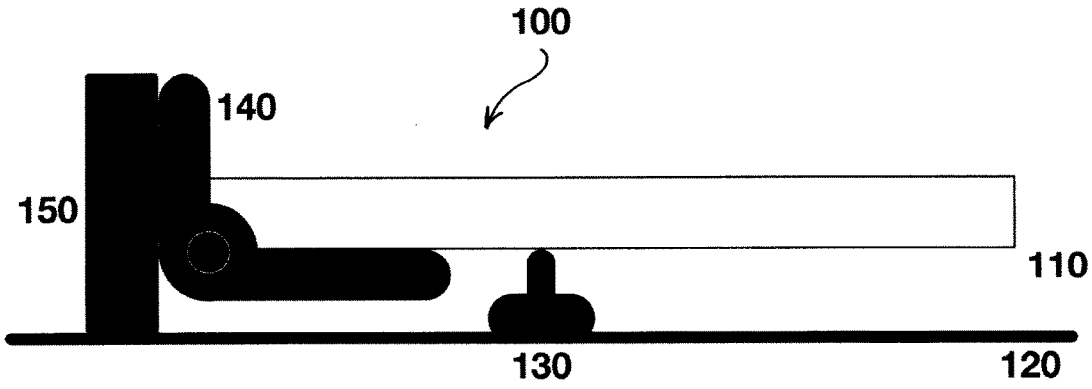
FIG. 1 is a side view of a first operational state of a first embodiment of a piano-type key actuator of the invention.
Figure 2:
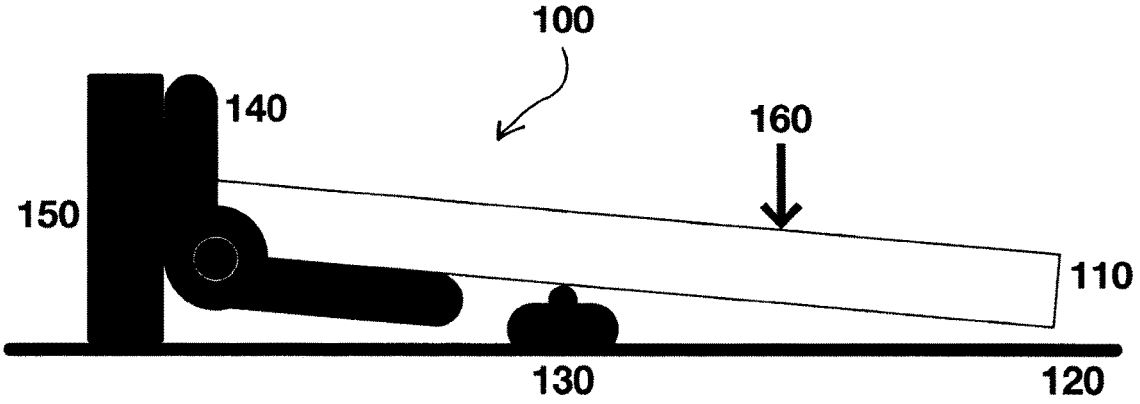
FIG. 2 is a side view of a second operational state of the embodiment in FIG. 1.
Figure 3:
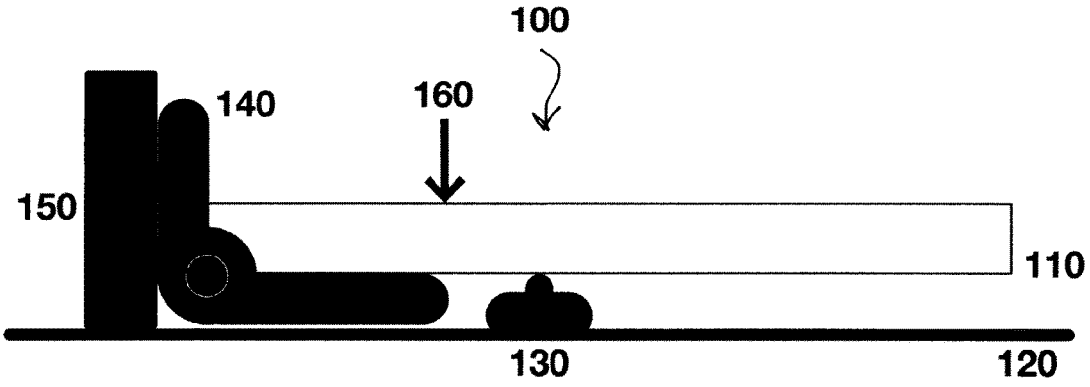
FIG. 3 is a side view of a third operational state of the embodiment in FIGS. 1 and 2.

A first embodiment of a piano-type key actuator of the invention is shown in FIGS. 1 to 3, and is designated generally as 100. This actuator 100 is comprised of a typical piano white key 110 that is attached at its pivot end to a horizontally oriented leaf of a hinge 140, and is supported along its bottom surface by the spring return action of a momentary pushbutton switch 130 that is affixed to a horizontally oriented surface 120 of the actuator 100. The horizontally oriented leaf of the hinge 140 is constrained to be rotated clockwise when the key 110 is engaged near its unattached end, and returned counterclockwise to its original horizontal orientation by the spring return action of the pushbutton switch 130 when the key 110 is released. A vertically oriented leaf of the hinge 140 is mounted to a vertically oriented surface 150 of the actuator 100, so as to enable the hinge 140 to be displaced downward when the key 110 is engaged near its attached end, and returned upward to its original location when the key 110 is released.

FIG. 1 shows the actuator 100 with no actuation force applied to the above mentioned key 110, such that it is maintained at its unengaged, horizontal orientation by the above mentioned spring return action of the pushbutton switch 130.

FIG. 2 shows the actuator 100 with a typical actuation force 160 applied sufficiently distant from the attached end of the above mentioned key 110, such that its resulting, counterclockwise leverage action will depress the aforementioned pushbutton switch 130, so as to thereby engage the key 110, after which, it can be released, and returned to the unengaged, horizontal orientation shown in FIG. 1.

FIG. 3 shows the actuator 100 with the same actuation force 160, but now no longer applied sufficiently distant from the attached end of the above mentioned key 110, such that the resulting, counterclockwise leverage action will NOT depress the aforementioned pushbutton switch 130; however, the resulting, downward displacement action will, so as to thereby supplementally engage the key 110, after which, it can be released, and returned to the unengaged, horizontal orientation shown in FIG. 1.

A second embodiment of a piano-type key actuator of the invention is shown in FIGS. 4 to 7, and is designated generally as 200. Similarly to the previous actuator 100, the current actuator 200 is comprised of the key 110 that is attached at its pivot end to the horizontally oriented leaf of the hinge 140, and is vertically supported by the pushbutton switch 130. The aforementioned rotation of the horizontally oriented leaf of the hinge 140 is constrained similarly to the previous actuator 100; however, unlike that actuator 100, the vertically oriented leaf of the hinge 140 is now mounted rigidly to the vertically oriented surface 150, so as to prevent displacement of the hinge 140. The current actuator 200 is further comprised of 8 touch sensors 201 to 208 being attached lengthwise along the top surface of the key 110, and a magnet 270 being attached to the bottom surface of the horizontally oriented leaf of the hinge 140.

Figure 4:
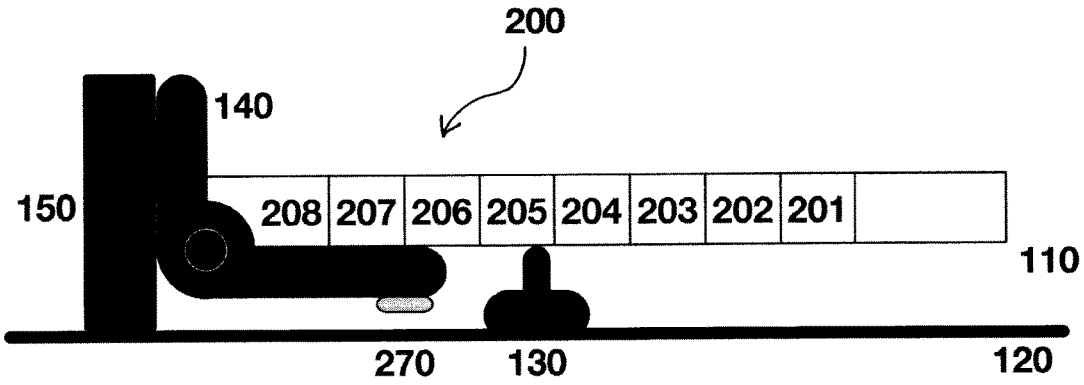
FIG. 4 is a side view of a first operational state of a second embodiment of a piano-type key actuator of the invention.

FIG. 4 shows the actuator 200 with no actuation force applied to the above mentioned key 110, such that it is maintained at its unengaged, horizontal orientation by the above mentioned spring return action of the pushbutton switch 130.

Figure 5:
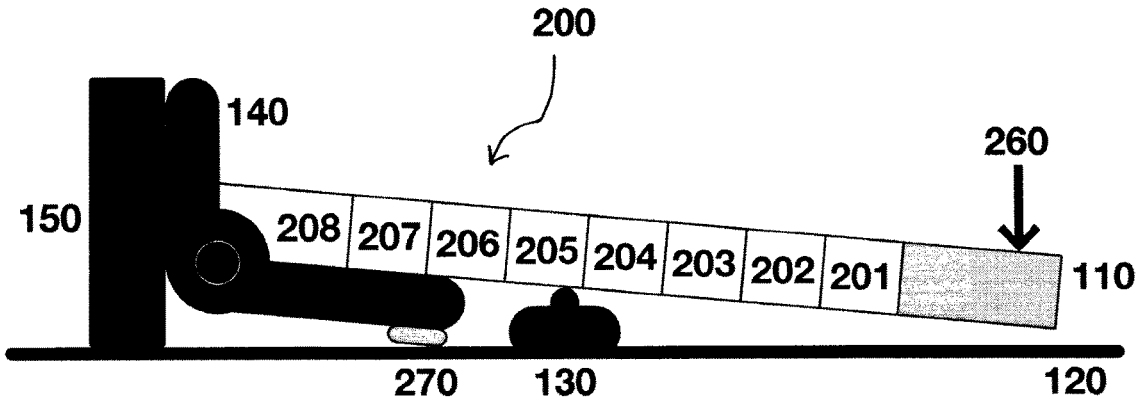
FIG. 5 is a side view of a second operational state of the embodiment in FIG. 4.

FIG. 5 shows the actuator 200 with a typical actuation force 260 applied sufficiently distant from the attached end of the above mentioned key 110, such that its resulting, counterclockwise leverage action will depress the aforementioned pushbutton switch 130, so as to thereby engage the key 110, after which, it can be released, and returned to the unengaged, horizontal orientation shown in FIG. 4.

Figure 6:
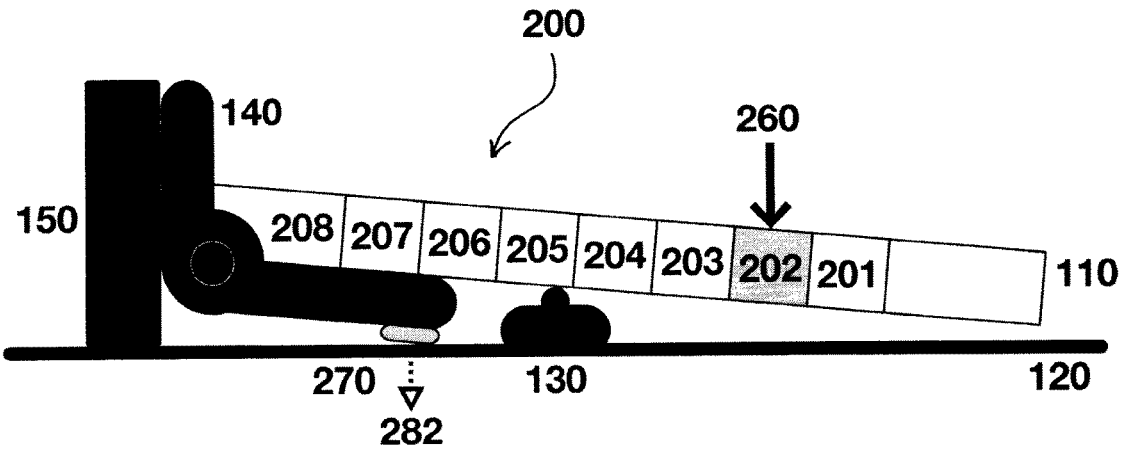
FIG. 6 is a side view of a third operational state of the embodiment in FIGS. 4 and 5.

FIG. 6 shows the actuator 200 with the same actuation force 260, but now applied to the second touch sensor 202 of the above mentioned key 110, which is no longer sufficiently distant from the attached end of the key 110, such that the resulting, counterclockwise leverage action will NOT depress the above mentioned pushbutton switch 130; however, by now touching that second touch sensor 202, a corresponding, downward electromagnetic force (EMF) 282 will be applied to the above mentioned magnet 270, so as to commensurately enhance that counterclockwise leverage action, and thereby supplementally engage the key 110, after which, it can be released, and returned to the unengaged, horizontal orientation shown in FIG. 4.

Figure 7:
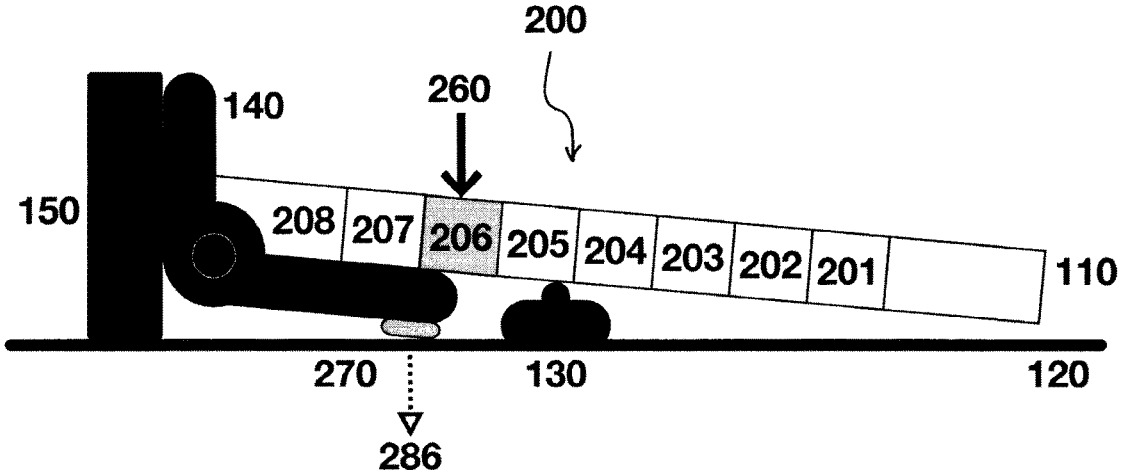
FIG. 7 is a side view of a fourth operational state of the embodiment in FIGS. 4, 5, and 6.

FIG. 7 shows the actuator 200 with the same actuation force 260, but now applied to the sixth touch sensor 202 of the above mentioned key 110, which is yet even closer to the attached end of that key 110, such that the resulting, counterclockwise leverage action will again NOT depress the above mentioned pushbutton switch 130; however, with the touching of that sixth touch sensor 202, a now even larger, downward electromagnetic force (EMF) 282 will be applied to the above mentioned magnet 270, so as to once again commensurately enhance that counterclockwise leverage action, and thereby supplementally engage the key 110, after which, it can be released, and returned to the unengaged, horizontal orientation shown in FIG. 4.

Figure 8:
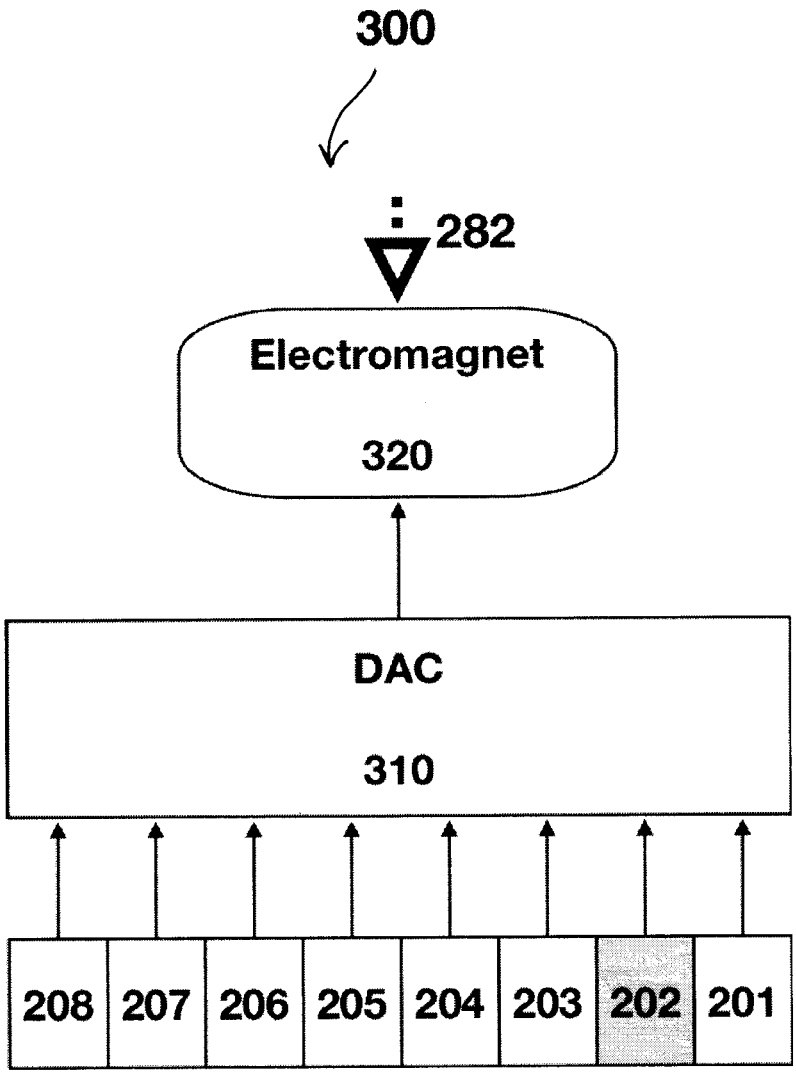
FIG. 8 is an operational state diagram of the operational state in FIG. 6.
Figure 9:
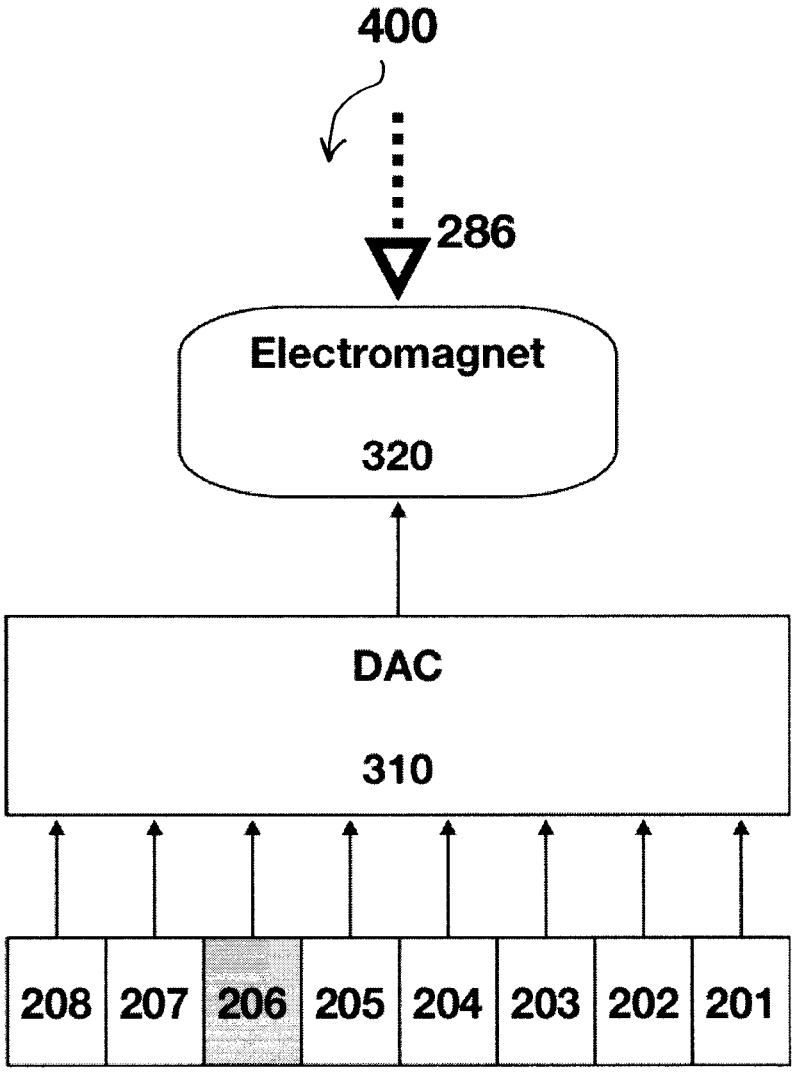
FIG. 9 is an operational state diagram of the operational state in FIG. 7.

FIGS. 8 and 9 respectively show the operational state diagrams 300 and 400 for the operational states of the invention respectively shown in FIGS. 6 and 7. The diagrams 300 and 400 show the outputs of the aforementioned 8 touch sensors 201 to 208, with each being connected to a digital input of a digital-to-analog converter (DAC) 310, such that the resulting analog output voltage of the DAC 310, as well as the input voltage and output EMF of a connected electromagnet 320, will inversely correspond to the distance from the aforementioned attached end of the key 110, for that touch sensor 202 or 206, respectively, to which the aforementioned actuation force 260 is applied (as is indicated by the highlighting of touch sensor 202 or 206 in FIG. 6 or 7, respectively). This will, as discussed above, apply a corresponding EMF 282 or 286, respectively, to the above mentioned magnet 270, and commensurately enhance the counterclockwise leverage action of the key 110, so as to depress the pushbutton switch 130, and thereby supplementally engage the key 110.

The present invention may be embodied in other specific forms without departing from the spirit or essential attributes thereof. Accordingly, reference should be made to the appended claims, rather than the foregoing specification, as indicating the scope of the invention.

I claim:

1. A lever actuator apparatus, including:

a lever beam;

a lever arm portion of said lever beam, where:

an actuation force can be applied to said lever arm; and a displacement of said lever arm can result from such application;

a linked mechanism that can be actuated by said displacement;

pivotal means to actuate said linked mechanism;

supplemental means to actuate said linked mechanism, including a subset of:

a first supplemental means, including:

linear such displacement of said lever arm; and triggering said linked mechanism with said linear displacement; and a second supplemental means, including:

quantification of said lever arm portion;

an auxiliary force inversely related to said quantification;

augmentation of said actuation force with said auxiliary force; and triggering said linked mechanism with said actuation force so augmented.

2. A lever actuator apparatus as in claim 1, further including a lever-type key.

3. A lever actuator apparatus as in claim 2, where:

said lever-type key is suitable for a keyboard; and said keyboard is a subset of:

an electronic keyboard;

a digital keyboard;

an analog keyboard;

a mechanical keyboard;

a physical keyboard;

a musical instrument keyboard;

a piano-type keyboard;

a piano keyboard;

an organ keyboard;

an accordion keyboard;

a synthesizer keyboard;

a keyboard with at least one weighted-action key;

a keyboard with at least one hammer-action key;

a keyboard with at least one touch-sensitive key;

a keyboard with at least one velocity-sensitive key;

a keyboard with at least one pressure-sensitive key;

a keyboard with at least one distance-sensitive key;

a keyboard with at least one soft pedal;

a keyboard with at least one sostenuto pedal;

a keyboard with at least one sustain pedal;

a keyboard with polyphonic sound;

a keyboard with amplified sound; and a keyboard with effect-processed sound.

4. A lever actuator apparatus, including:

a lever beam;

a lever arm portion of said lever beam, where:

an actuation force can be applied to said lever arm; and a displacement of said lever arm can result from such application;

a linked mechanism that can be actuated by said displacement;

pivotal means to actuate said linked mechanism; and supplemental means to linearly actuate said linked mechanism, including:

linear such displacement of said lever arm; and triggering said linked mechanism with said linear displacement.

5. A lever actuator apparatus as in claim 4, further including a lever-type key.

6. A lever actuator apparatus as in claim 5, where:

said lever-type key is suitable for a keyboard; and said keyboard is a subset of:

an electronic keyboard;

a digital keyboard;

an analog keyboard;

a mechanical keyboard;

a physical keyboard;

a musical instrument keyboard;

a piano-type keyboard;

a piano keyboard;

an organ keyboard;

an accordion keyboard;

a synthesizer keyboard;

a keyboard with at least one weighted-action key;

a keyboard with at least one hammer-action key;

a keyboard with at least one touch-sensitive key;

a keyboard with at least one velocity-sensitive key;

a keyboard with at least one pressure-sensitive key;

a keyboard with at least one distance-sensitive key;

a keyboard with at least one soft pedal;

a keyboard with at least one sostenuto pedal;

a keyboard with at least one sustain pedal;

a keyboard with polyphonic sound;

a keyboard with amplified sound; and a keyboard with effect-processed sound.

7. A lever actuator apparatus, including:

a lever beam;

a lever arm portion of said lever beam, where:

an actuation force can be applied to said lever arm; and a displacement of said lever arm can result from such application;

a linked mechanism that can be actuated by said displacement;

pivotal means to actuate said linked mechanism; and supplemental means to pivotally actuate said linked mechanism, including:

quantification of said lever arm portion;

an auxiliary force inversely related to said quantification;

augmentation of said actuation force with said auxiliary force; and triggering said linked mechanism with said actuation force so augmented.

8. A lever actuator apparatus as in claim 7, further including a lever-type key.

9. A lever actuator apparatus as in claim 8, where:

said lever-type key is suitable for a keyboard; and said keyboard is a subset of:

an electronic keyboard;

a digital keyboard;

an analog keyboard;

a mechanical keyboard;

a physical keyboard;

a musical instrument keyboard;

a piano-type keyboard;

a piano keyboard;

an organ keyboard;

an accordion keyboard;

a synthesizer keyboard;

a keyboard with at least one weighted-action key;

a keyboard with at least one hammer-action key;

a keyboard with at least one touch-sensitive key;

a keyboard with at least one velocity-sensitive key;

a keyboard with at least one pressure-sensitive key;

a keyboard with at least one distance-sensitive key;

a keyboard with at least one soft pedal;

a keyboard with at least one sostenuto pedal;

a keyboard with at least one sustain pedal;

a keyboard with polyphonic sound;

a keyboard with amplified sound; and a keyboard with effect-processed sound.

* * * * *